US008028429B2

(12) United States Patent
Mears

(10) Patent No.: US 8,028,429 B2
(45) Date of Patent: Oct. 4, 2011

(54) APPARATUS FOR HANGING OBJECTS

(76) Inventor: Paul Mears, Salt Lake City, UT (US)

( * ) Notice: Subject to any disclaimer, the term of this patent is extended or adjusted under 35 U.S.C. 154(b) by 0 days.

(21) Appl. No.: 12/684,690

(22) Filed: Jan. 8, 2010

(65) Prior Publication Data

US 2011/0168858 A1 Jul. 14, 2011

(51) Int. Cl.
*B43L 7/00* (2006.01)

(52) U.S. Cl. ..... 33/429; 33/427

(58) Field of Classification Search ..... 33/429, 33/418, 420, 404, 427, 430
See application file for complete search history.

(56) References Cited

U.S. PATENT DOCUMENTS

| | | | | | |
|---|---|---|---|---|---|
| 2,655,729 | A | * | 10/1953 | Panske | 33/481 |
| 3,530,591 | A | * | 9/1970 | Moffitt | 33/613 |
| 3,982,719 | A | | 9/1976 | Kilborne | |
| 4,496,128 | A | | 1/1985 | Larsen | |
| 4,513,510 | A | * | 4/1985 | Swanson | 33/419 |
| 4,637,583 | A | | 1/1987 | Babitz | |
| 4,645,165 | A | | 2/1987 | Raap | |
| 4,883,247 | A | | 11/1989 | Crandall | |
| 5,069,411 | A | | 12/1991 | Murphy | |
| 5,103,573 | A | | 4/1992 | Ehling et al. | |
| 5,170,568 | A | * | 12/1992 | Wright | 33/480 |
| 5,303,895 | A | | 4/1994 | Hart | |
| D361,260 | S | | 8/1995 | Trentham | |
| 5,509,213 | A | | 4/1996 | Kelly et al. | |
| 5,542,641 | A | | 8/1996 | Donovan | |
| 5,636,825 | A | | 6/1997 | Pernas | |
| 5,704,263 | A | * | 1/1998 | Swanberg | 33/429 |
| 5,727,325 | A | * | 3/1998 | Mussell | 33/429 |
| 5,743,507 | A | | 4/1998 | Rushing | |
| 5,749,558 | A | | 5/1998 | Wallo | |
| 5,933,974 | A | * | 8/1999 | Walters et al. | 33/474 |
| 6,003,825 | A | | 12/1999 | Abernathy, Jr. | |
| 6,032,378 | A | * | 3/2000 | Null | 33/451 |
| 6,042,078 | A | | 3/2000 | Donovan | |
| 6,095,479 | A | | 8/2000 | Brindisi | |
| 6,152,418 | A | | 11/2000 | Panicci | |
| 6,550,739 | B1 | | 4/2003 | Brindisi | |
| 6,557,813 | B1 | | 5/2003 | Duggan | |
| 6,578,278 | B2 | * | 6/2003 | Siefert | 33/429 |
| 6,688,014 | B1 | * | 2/2004 | Allemand | 33/474 |
| 6,868,616 | B2 | * | 3/2005 | Allemand | 33/476 |
| 6,886,268 | B1 | * | 5/2005 | Morse | 33/647 |
| 6,962,016 | B1 | | 11/2005 | Meyer | |
| 6,971,184 | B2 | * | 12/2005 | Prevost | 33/613 |
| 7,316,078 | B2 | * | 1/2008 | Hagman | 33/613 |
| 7,398,601 | B2 | * | 7/2008 | Morrell | 33/429 |
| 7,448,507 | B1 | | 11/2008 | Abernathy, Jr. | |
| 7,546,687 | B2 | * | 6/2009 | Haala | 33/415 |
| 7,578,492 | B2 | * | 8/2009 | Darre' | 248/477 |
| 7,797,853 | B2 | * | 9/2010 | Compton | 33/613 |
| 2003/0204963 | A1 | * | 11/2003 | Siefert | 33/429 |
| 2004/0231175 | A1 | * | 11/2004 | Allemand | 33/429 |
| 2006/0060748 | A1 | * | 3/2006 | Darre | 248/476 |
| 2007/0277387 | A1 | * | 12/2007 | Morrell | 33/429 |
| 2010/0139106 | A1 | * | 6/2010 | Atwood | 33/418 |

* cited by examiner

*Primary Examiner* — Yaritza Guadalupe
(74) *Attorney, Agent, or Firm* — Morriss O'Bryant Compagni, P.C.

(57) ABSTRACT

An apparatus for hanging an object from a wall comprises a generally triangular-shaped frame having a horizontal portion, a vertical portion and cross-member between the vertical and horizontal portions. The vertical portion is configured for attachment to a wall stud. The horizontal portion defines an elongate slot that extends a substantial length of the horizontal portion. A hook member is slideably coupled to the slot and is configured to support a weight of an object suspended therefrom.

16 Claims, 9 Drawing Sheets

(Section A-A)

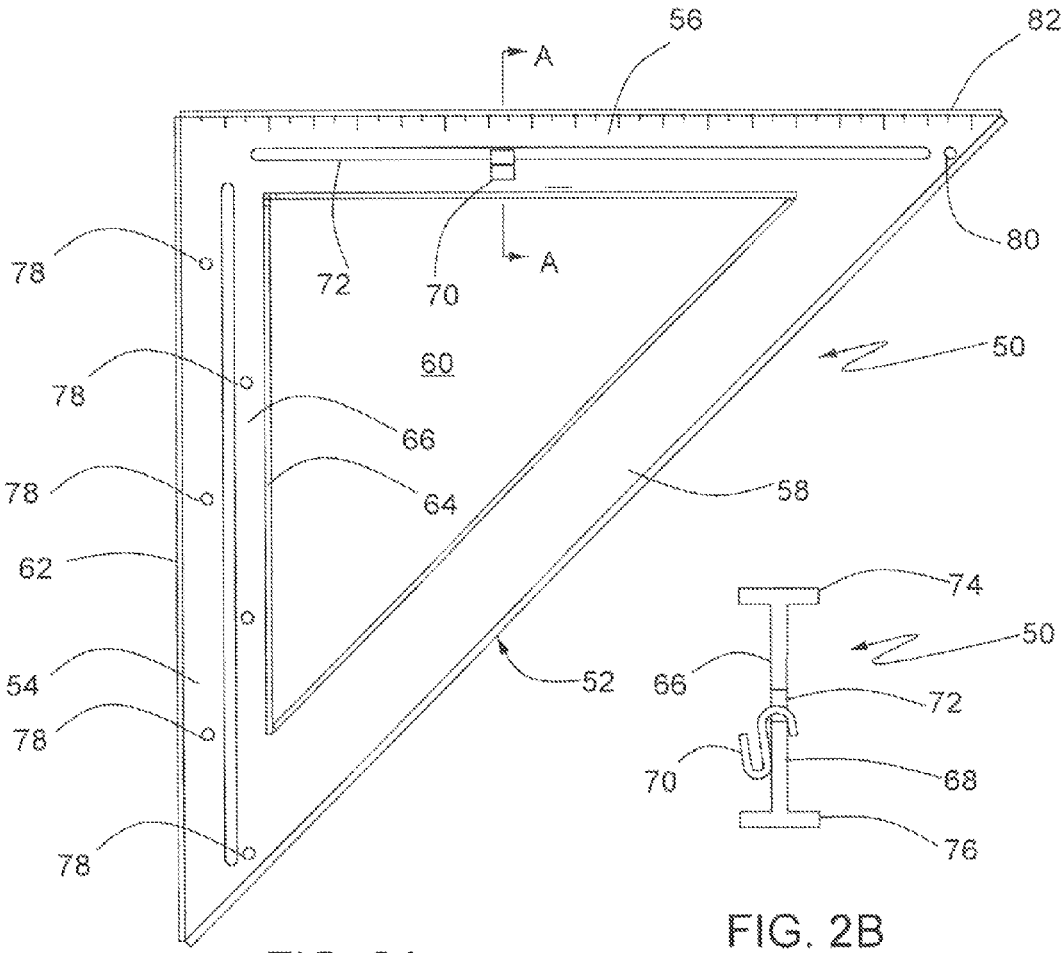
FIG. 2A
FIG. 2B
(Section A-A)
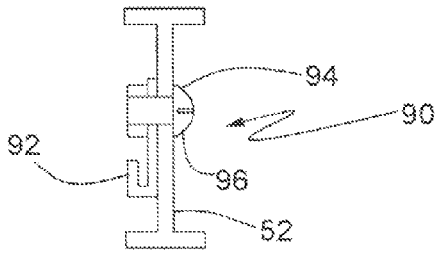
FIG. 3

(Section A-A)

(Section A-A)

APPARATUS FOR HANGING OBJECTS

BACKGROUND OF THE INVENTION

1. Field of the Invention

The present invention relates generally to devices for hanging larger objects, such as various decorative items, including, but not limited to, large scale paintings, large scale picture frames, large mirrors and the like, to a wall where substantial weight must be supported and the desired point of support is between wall studs, and more specifically to an apparatus for hanging such items to a wall that has a first portion that is coupled to a wall stud and a second portion that extends over the surface of the wall to a location between wall studs that is configured to support a heavy object.

2. State of the Art

Various devices for hanging decorative items on a wall are well known in the art. In wood stud and gypsum board (e.g., SHEET ROCK) construction, walls are formed from evenly spaced, vertical wood studs that are covered by gypsum board. The gypsum board may then be textured, if desired, and painted. Once the wall is completed, if one desires to hang a heavy object on the wall, they must either anchor the object through the gypsum board and into one of the studs, or use an anchoring device that is coupled to the gypsum board.

Such anchoring devices include plastic inserts that are hammered or screwed into a hole in the gypsum board. These devices are configured to receive a metal screw that is threaded into the plastic insert causing the insert to expand in the hole and retain the screw relative to the gypsum board. The screw is then used as an anchor for supporting a decorative object.

Another type of anchoring system employs the use of an expandable metal insert that is inserted through a hole in the gypsum board and then expands to engage the back side surface of the gypsum board, thus preventing the anchoring system from being pulled back through the hole.

In each of the foregoing anchoring systems that are coupled to the gypsum board, they rely on the strength of the gypsum board to support the anchoring system and thus the entire weight of the decorative item coupled thereto. In the case of large mirrors or paintings, the weight of such objects can easily exceed 50 pounds and many can weight a hundred pounds or more.

Thus, there exists a need in the art to provide an apparatus for supporting a heavy decorative item that is easy to install, does not rely solely on the strength of the gypsum board to support the object, and allows for easy and adjustable placement between wall studs.

SUMMARY OF THE INVENTION

In accordance with the invention there is provided an apparatus for hanging an object from a wall comprising a generally triangular-shaped frame having a horizontal portion, a vertical portion having a first end depending from a second end of the horizontal portion at a right angle to the horizontal portion, and a hypotenuse portion having a first end depending from a first second end of the vertical portion and a second end depending from a first end of the horizontal portion. The vertical portion is configured for attachment to a wall stud or other similar structure. A slot is formed in the horizontal portion and extends a substantial length of the horizontal portion and parallel to a longitudinal axis of the horizontal portion. A hook member is slideably coupled to the slot of the horizontal portion and freely movable along an entire length of the slot. The hook member is configured to support a weight of an object suspended therefrom. The vertical, horizontal and hypotenuse portions of the frame are integrally formed as a one-piece structure.

The vertical portion includes a plurality of holes formed therein for receiving fasteners therethrough for attaching the vertical portion to a wall stud or similar support structure.

In one embodiment, the slot is provided with a plurality of evenly spaced protrusions that are wider than a width of the hook member and provided for discrete placement of the hook member relative to the slot.

In yet another embodiment, the frame includes inner and outer walls to form an I-beam.

In still another embodiment, each frame portion includes a transversely extending wall depending from an outer perimeter of the frame and an elongate protrusion extending a substantial portion of the frame portion in a lateral direction opposite to the respective transversely extending wall. The walls and protrusions provide space between the frame and a support wall to which the frame is to be attached to allow the hook member to freely slide along the slot and at least partially within the space.

In still another embodiment, the vertical portion of the frame defines a second slot that is parallel to a longitudinal axis of the vertical portion and wherein the horizontal portion is configured for attachment to a support wall stud. In this configuration, the vertical portion can be horizontally oriented with the horizontal portion being vertically oriented and the hook member being coupled to the second slot.

In another embodiment, the hook member comprises a one-piece, S-shaped member having a first portion for being inserted through the slot and resting on the horizontal portion adjacent to the slot and a second portion for hanging an object therefrom.

In yet another embodiment, the horizontal and vertical portions of the apparatus are at least approximately 8 inches in length.

In still another embodiment, an apparatus for hanging an object from a wall includes a frame having a first elongate member depending from a second elongate member at a right angle thereto. The first elongate member includes a first elongate portion lying in a first plane and is configured for attachment to a wall and a second elongate portion lying in a second plane and spaced from the first portion to form a first slot therein between. The second elongate member includes a first elongate portion lying in the first plane and configured for attachment to a wall, a second elongate portion lying in the second plane and spaced from the first portion to form a second slot therein between. A hook assembly is configured for being slideably coupled to the first slot when said first slot is horizontally oriented and to the second slot when the second slot is horizontally oriented.

In yet another embodiment, the first and second members are provided with distance markings proximate to the first and second slots.

The foregoing advantages and characterizing features will become apparent from the following description of certain illustrative embodiments of the invention. The above-described features and advantages of the present invention, as well as additional features and advantages, will be set forth or will become more fully apparent in the detailed description that follows and in the appended claims. The novel features which are considered characteristic of this invention are set forth in the attached claims. Furthermore, the features and advantages of the present invention may be learned by the practice of the invention, or will be obvious to one skilled in the art from the description, as set forth hereinafter.

BRIEF DESCRIPTION OF THE DRAWINGS

The following drawings illustrate exemplary embodiments for carrying out the invention. Like reference numerals refer to like parts in different views or embodiments of the present invention in the drawings.

FIG. 2A is a front view of a second embodiment of an apparatus for hanging objects from a wall in accordance with the principles of the present invention.

FIG. 2B is a cross-sectional side view of a portion of the apparatus illustrated in FIG. 2A taken through section A-A.

FIG. 3 is a cross-sectional side view of a portion of an alternative hanger assembly coupled to the apparatus illustrated in FIG. 2A in accordance with the principles of the present invention.

DETAILED DESCRIPTION OF THE INVENTION

Figure 1A:
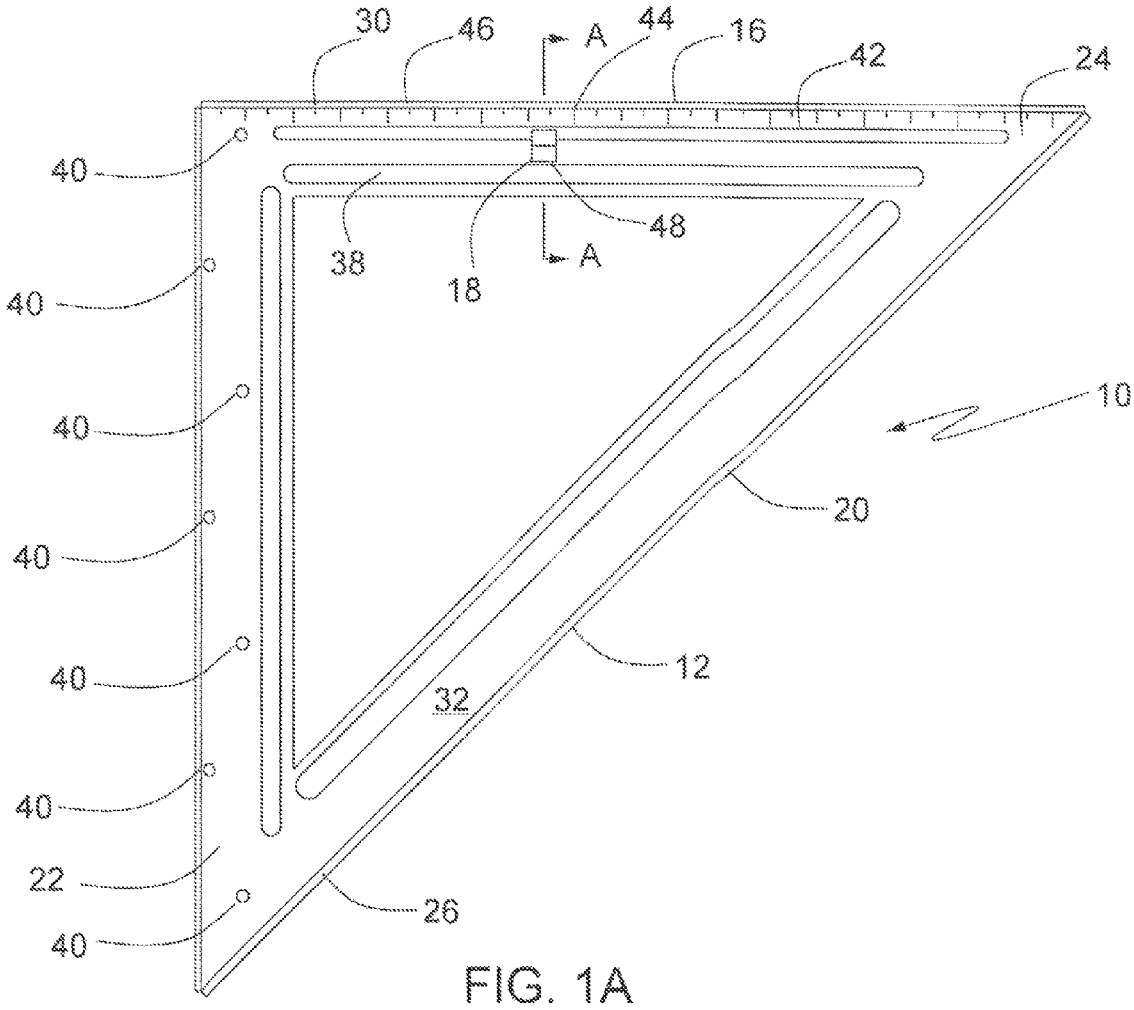
FIG. 1A is a front view of a first embodiment of an apparatus for hanging objects from a wall in accordance with the principles of the present invention.

As illustrated in FIG. 1A, a generally triangularly shaped apparatus for hanging objects such as decorative items on a wall is illustrated. The object hanger, generally indicated at 10, is comprised of a rectangular-shaped frame 12 having a vertical side member 14 configured for attachment to a wall, a horizontal top member 16 configured for supporting an adjustable hanging member 18 and an interconnected cross-member 20 that extends between the distal ends 22 and 24 of the vertical and horizontal members 14 and 16, respectively. The members 14, 16 and 20 may be integrally formed as shown or comprised of individual components that are coupled together or a combination thereof. In order to provide lateral stability and strength to the object hanger 10, the frame 12 is provided with laterally extending perimeter walls 26, 28 and 30 that extend outwardly from the frame surface 32 and are provided along substantially the entire perimeter of the hanger 10. In addition, inwardly extending channels 32, 34 and 36 are formed in the surface 32 of the frame 12 that result in raised projections on the opposite side of the frame 12 provide additional structural rigidity to the frame 12. In addition to providing structural rigidity and strength, the raised walls 12, 14 and 20 provide spacing between the frame surface 32 and a wall to which the frame is attached when the frame is attached with the surface 32 facing a wall. Similarly, the channels 34, 36 and 38 provide spacing on the opposite side of the frame (as will be further illustrated) between the frame 12 and a wall. The frame 12 may be formed from metal such as steel or plastic depending on the weight to be supported. For metal construction, the frame 12 may be manufactured as a one-piece structure by stamping, as is commonly used in the art. Plastic configurations of the frame 12 may be molded or machined in order to produce a unitary, one-piece structure as illustrated.

The vertical frame member 14 is provided with a plurality of holes 40 that are spaced along a substantial length of the member 14. The holes 40 are configured for receiving a threaded fastener or nail therethrough in order to secure the frame 20 to a stud of a wall. By securely fastening the member 14 to a wall stud, the device will not be dislodged from the gypsum board due to the weight of any decorative object up to a certified weight limit. The member 16 is thus supported by both frame members 14 and 20 in a cantilever fashion over the surface of a wall.

The hanging member 18 is partially received in the slot 42 that extends along a substantial portion of the length of the member 16. The slot 42 allows the hanging member 18 to be slid along its length to provide adjustability of the position of the hanging member 18 relative to the slot 42. Distance indication marks 44 may be provided on the member 16 between the slot 42 and the top edge 46 of the member 16 to allow for relatively precise placement of the hanging member 18. For typical wall construction where the distance between centers of wall studs is 16 inches, the length of the slot 42 is at least eight inches. If the desired center position of the object to be hung is less than eight inches from a left side wall stud, the device 10 is attached to the wall in the orientation illustrated in FIG. 1A. If, however, the desired center position of the object to be hung is more than eight inches from the nearest left-side wall stud, the device 10 is flipped over to allow the vertical member 14 to be attached to the nearest right-side wall stud. The hanging member 18 is also flipped to the opposite side and reinserted into the slot 42. The user will attach the device 10 to a wall stud with the bottom 48 of the hanging member 18 at a desired height and adjust the position of the hanging member 18 to be at the center of the object to be hung. The hanging member 18 is configured to support a weight of an object suspended therefrom and thus may be formed from a metal such as steel or other material and of a thickness to support at least twice the weight of an object to be suspended therefrom in order to provide a sufficient safety factor.

Figure 1B:
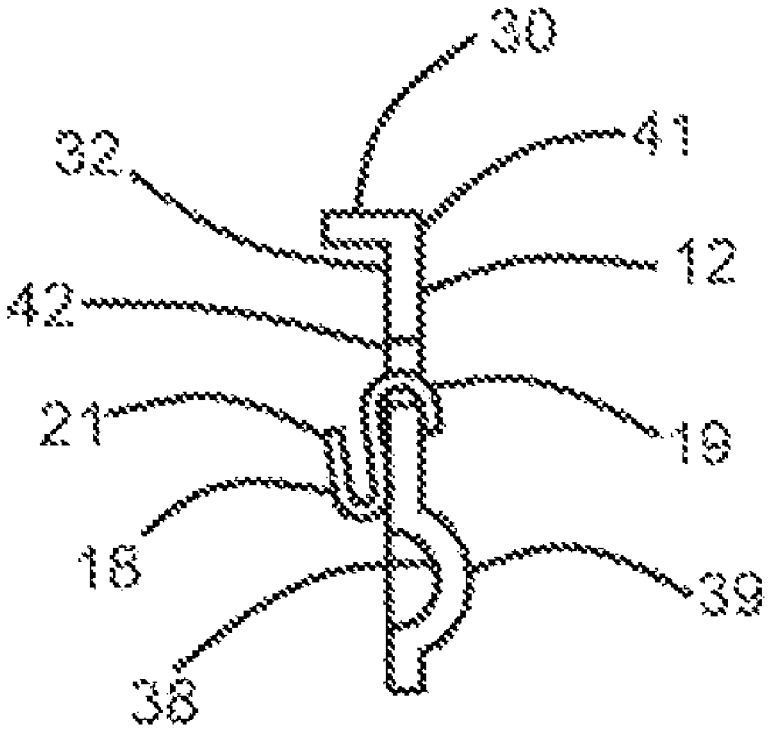
FIG. 1B is a cross-sectional side view of a portion of the apparatus illustrated in FIG. 1A taken through section A-A.

As shown in FIG. 1B, which is a cross-sectional view taken through section A-A of FIG. 1A, the frame 12 is constructed to allow the hanging member 18 to slide within the slot 42 when the frame 12 is attached to a wall. Thus, the frame 12 includes recess 30 that provides raised protrusion 39 to provide a space between a wall and the back side 41 of the frame 12 when the protrusion 39 is abutted against a wall. Likewise, perimeter walls, such as wall 30, are provided to provide a space between a wall and the front surface 32 of the frame 12 when the frame is attached in an opposite orientation. In such a case, the frame retaining portion 19 of the hanging member 18 would be inserted into the slot 42 from the back side 41 of the frame 12 such that the hook portion 21 is positioned on the back side 41. The spaces formed allow the hanging member 18 to be freely slide along the slot 42 for adjustability of the hanging member 18 relative to the slot 42.

Referring now to FIGS. 2A and 2B, there is illustrated an alternative embodiment of a device, generally indicated at 50, for hanging a decorative or other item therefrom. The device 50 is similarly triangularly configured as the device illustrated in FIG. 1A, but has a cross-section that forms an I-beam construction as shown in FIG. 2B. The device 50 is comprised of a one-piece frame 52 with vertical and horizontal portions 54 and 56, respectively, and the portion 58 forming a hypotenuse to the frame 52. The portions 54, 56 and 58 define an inner triangular space 60 therein between. Each portion 54, 56 and 58 is provided with an outer wall, such as outer wall 62 of portion 54, and an inner wall, such as inner wall 64. The inner and outer walls 62 and 64 transversely extend on both sides of the portion 54 to form channels or spaces 66 and 68 between the walls 62 and 64 that each circumscribes both sides of the frame 52. The spaces 66 and 68 provide room for the support hook 70 to freely slide along the slot 72 when the wall ends 74 and 76 abut against a wall to which the frame 12 is attached as with fasteners (not shown) through holes 78 in the vertical frame portion 54. For added stability a hole 80 proximate the distal end 82 of the frame portion 56 to attach the distal end 82 to the wall board as with a gypsum board fastener. Because the weight of any object supported by the hook member 70 and the frame 52 is born by the vertical portion 62 through fasteners securing the vertical portion 62 to a wall, the attachment through hole 80 does not need to bear weight, but is provided primarily to provide lateral stability to the frame 52 if desired.

As shown in FIG. 3, an alternative embodiment of a support hook assembly, generally indicated at 90 is illustrated. Rather than the one-piece, S-shaped hook shown in FIG. 2B, the hook assembly 90 is comprised of a J-hook member 92 that is attached to the frame 52 with a fastener 94, such as a screw and nut combination as illustrated, a rivet or other fasteners known in the art in which the head 96 of the fastener 94 abuts against a side of the frame 52 opposite the J-hook member 92 and secures the J-hook member 92 to the frame 52.

Figure 4A:
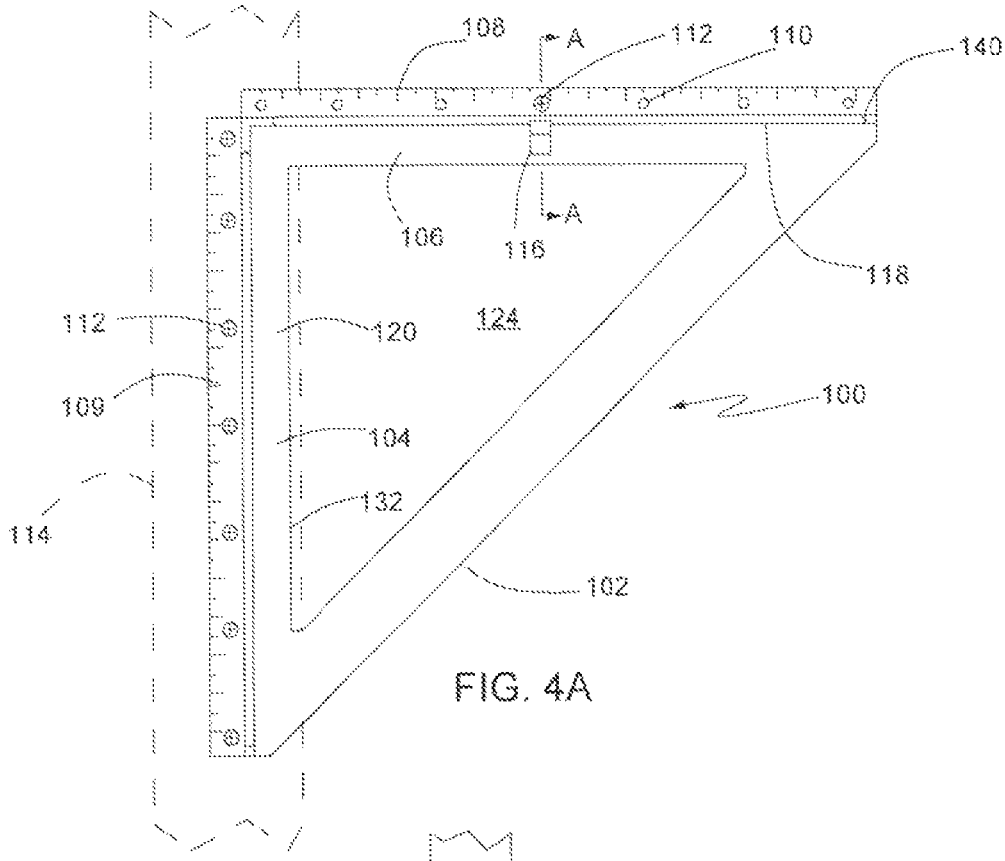
FIG. 4A is a front view of a third embodiment of an apparatus for hanging objects from a wall in a first orientation in accordance with the principles of the present invention.
Figure 4B:
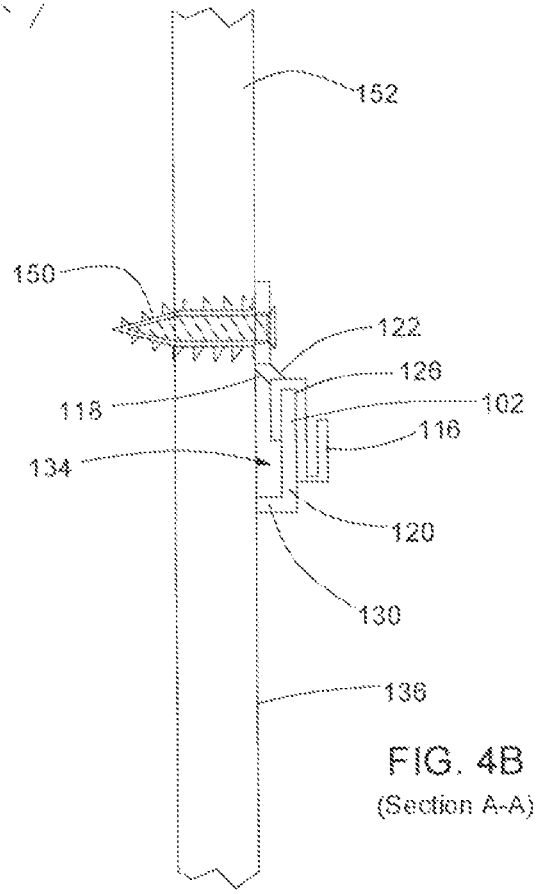
FIG. 4B is a cross-sectional side view of a portion of the apparatus illustrated in FIG. 4A taken through section A-A and shown attached to a wall.

FIGS. 4A and 4B illustrate yet another embodiment of an object supporting device, generally indicated at 100 in accordance with the principles of the present invention. The device 100 is comprised of a triangular frame 102. The two portions 104 and 106 that are at a right angle to each other are similarly configured. Thus, the portion 106 includes a longitudinally extending flat portion 108 that forms an outer flange with holes 110 provided for receiving a fastener 112, such as a nail or screw, there through for attaching the flat portion to a wall and against a wall surface. Likewise, the flat portion 109 when vertically oriented can be attached with a plurality of fasteners 112 to a wall stud 114. The portion 106 is then cantilevered over the wall and is provided with an S-shaped hook member 116 positioned in slot 118. The inner portion 120 of the frame 102 adjacent to the flat portions 108 and 109 are raised above the wall such that there is a rising sloped portion 122 between the flat portion 108 and the inner portion 120. The slot 118 is provided in the rising sloped portion 122. The hook member 116 can thus be easily slide over the top edge 126 of the inner portion 120. Defining the inner triangular space 124 is inwardly depending wall portion 130 that provides an abutment for the inner perimeter 132 of the frame 102. An underlying space 134 is defined between the sloped portion 122, the inner portion 120 and the wall portion 130. This underlying space 134 provides clearance between the back of the frame 102 and the wall surface 136 to allow the hook member 116 to freely slide along the slot 118 for adjustability.

Figure 4C:
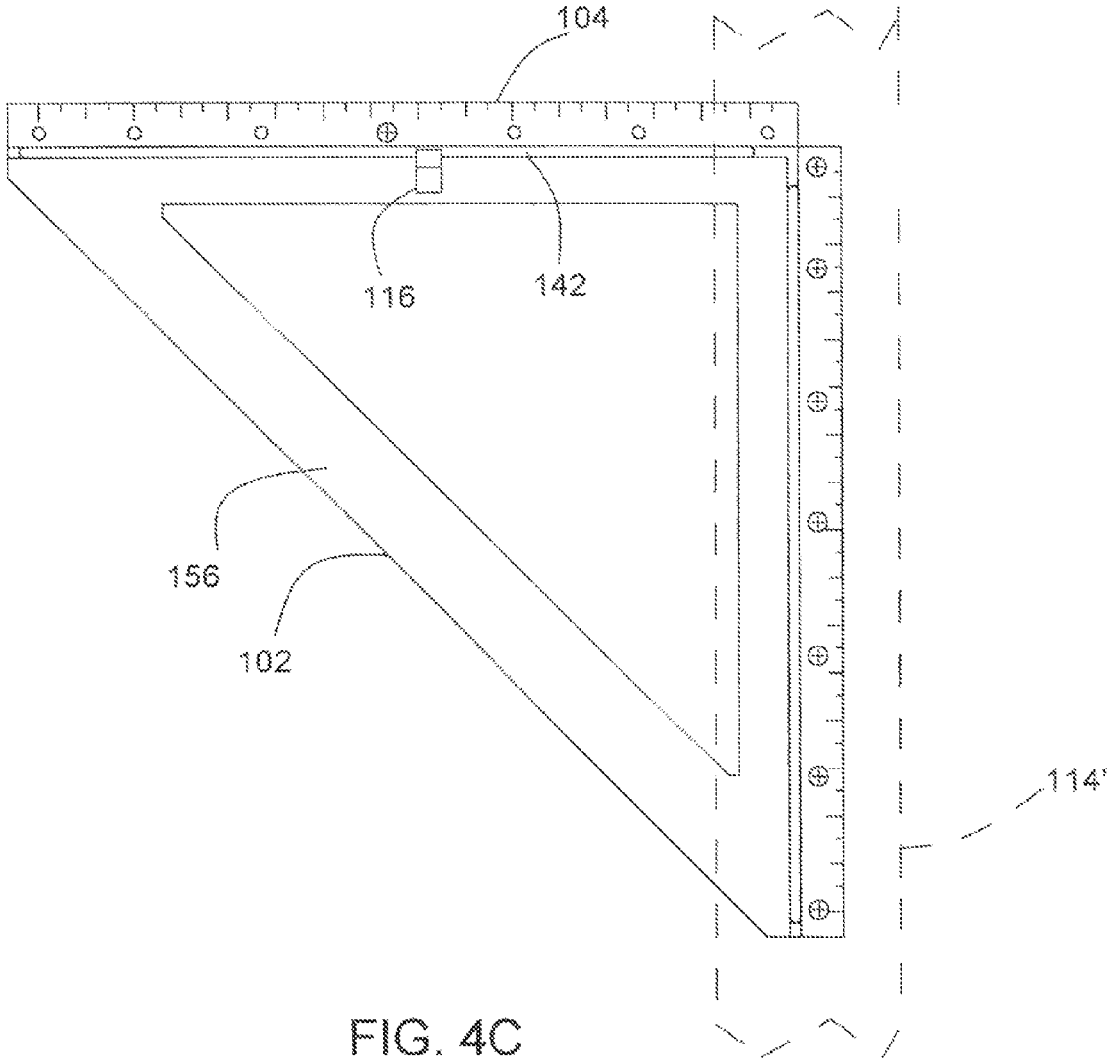
FIG. 4C is a front view of the apparatus illustrated in FIG. 4A in a second orientation.

The orientation of the frame 102 relative to the wall stud 114 is desired when the hanging point of an object to be hung on the hook member 116 is within a distance of the wall stud 114 less than or equal to the distal end 140 of the slot 118. As shown in FIG. 4C, if the hanging point of an object to be hung on the hook member 116 is nearer the next adjacent wall stud 114' to the right of the wall stud 114, the frame 102 is rotated ninety degrees into the position shown in FIG. 4C and the hook member 116 is moved to the slot 142 of frame portion 104. Because the frame portion 104 is configured similarly to that of frame portion 106, the frame portion 104 will be of the same configuration as that shown in FIG. 4B. If desired, a sheet rock fastener 150 may be employed to attach the horizontally oriented and cantilevered portion to the wall board 152 where no wall stud exists. The diagonal cross-member 156 provides buttressing-type support between the horizontal and vertical portions of the frame 102 and may be in the same plane as and form an integral part of the inner portion 120. In addition, the cross-member may include one or two inwardly depending walls that space the cross-member from the wall of a configuration similar to the wall 130 shown in FIG. 4B. This ensures, that the inner portion 120 of the frame 102 is uniformly spaced from the wall around its entire perimeter to prevent flexing or bending of the frame 102 when being attached to a wall and to ensure that the frame 102 is substantially entirely flush mounted to the surface 136 of the wall.

Figure 5:
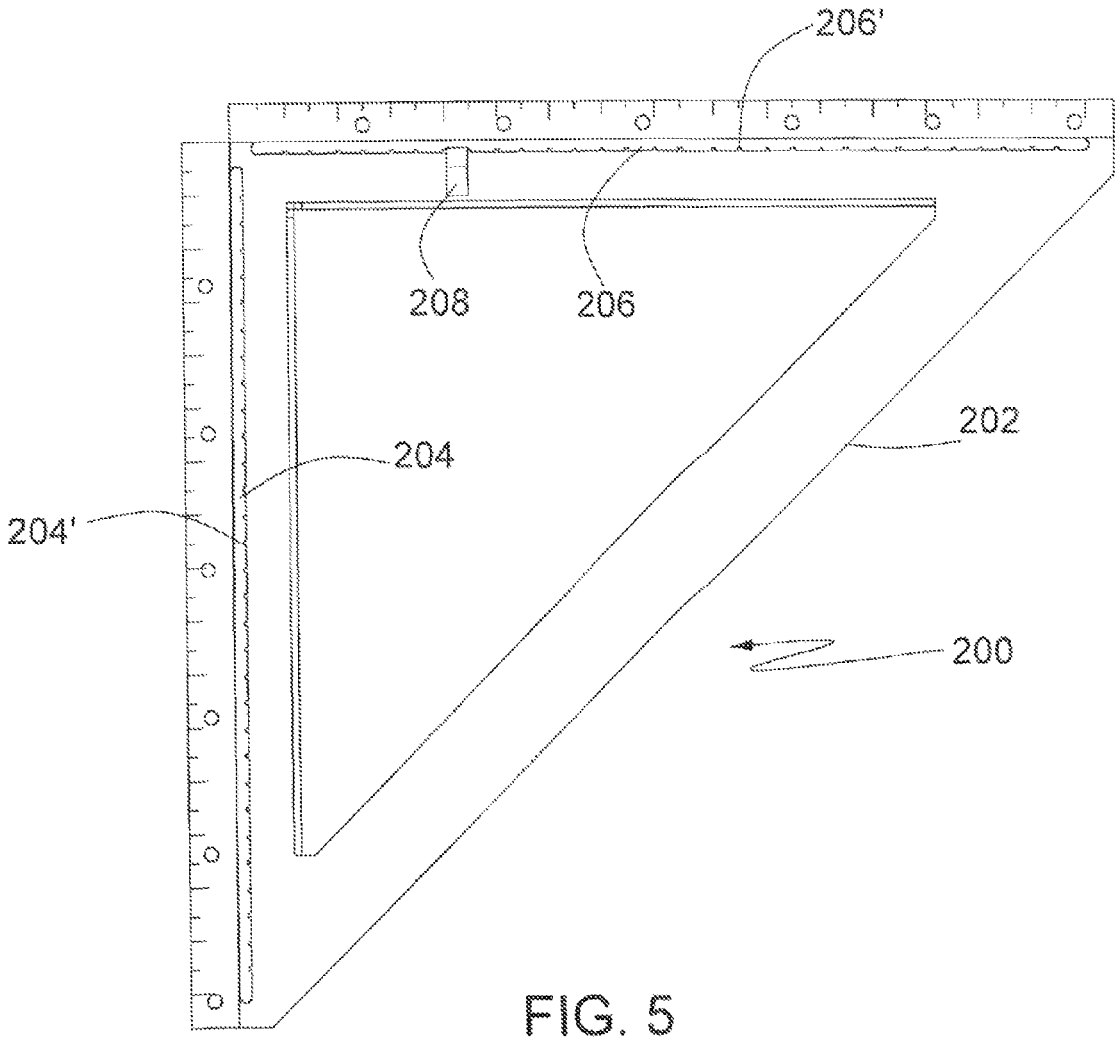
FIG. 5 is a front view of a fourth embodiment of an apparatus for hanging objects from a wall in accordance with the principles of the present invention.

As further illustrated in FIGS. 5 and 6, a device according to the present invention may be provided with slots of different configurations. As shown in FIG. 5, device 200 includes a frame 202 that define a pair of slots 204 and 206 configured for receiving and supporting a hook 208 when the slot 204 or 206 is horizontally oriented. Each slot 204 and 206 is provided with a "saw tooth" configuration with evenly spaced projections 204' and 206', respectively. The projections 204' and 206' are spaced a distance to accommodate the width of the hook 208 therein between to cause the hook 208 to be positioned and maintained at discrete locations along the slots 204 and 206. This prevents the hook 208 from being inadvertently slid along the slots 204 and 206 when properly positioned. The hook 208, however, can be moved to another location by lifting the hook 208 and moving it to another slot position between projections 204' or 206', as the case may be, at that location.

Figure 6A:
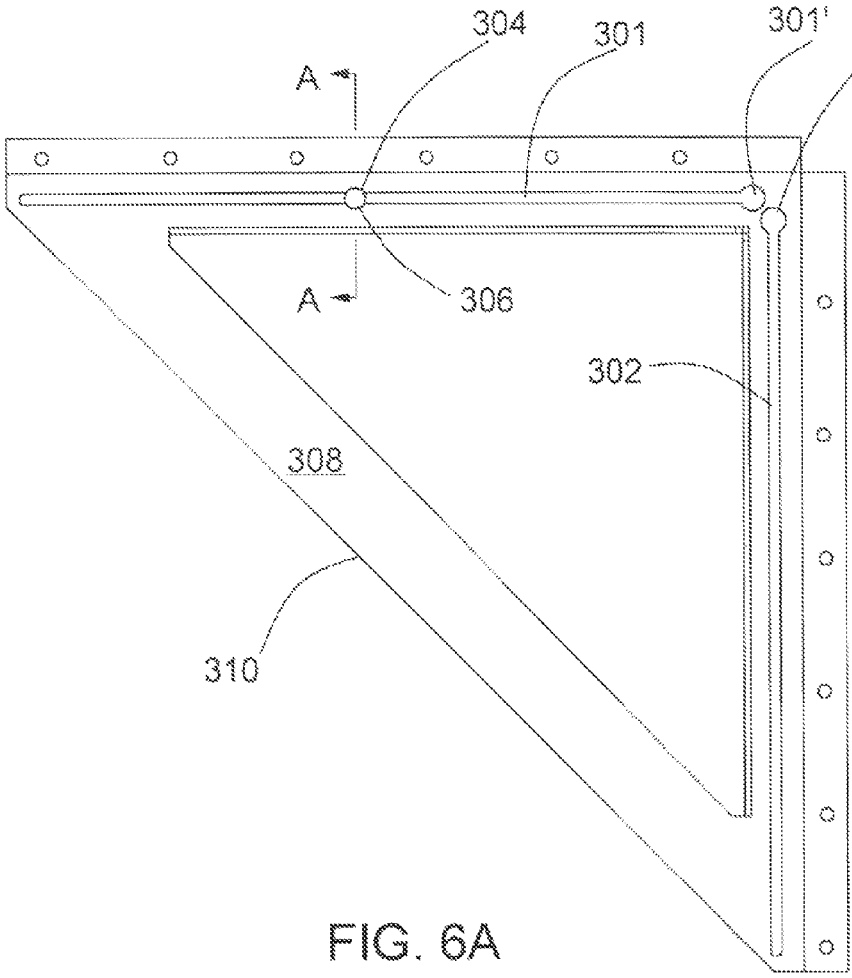
FIG. 6A is a front view of a fifth embodiment of an apparatus for hanging objects from a wall in accordance with the principles of the present invention.
Figure 6B:
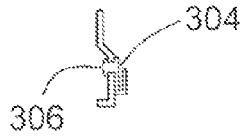
FIG. 6B is a cross-sectional side view of a portion of the apparatus illustrated in FIG. 6A taken through section A-A.

FIGS. 6A and 6B illustrate slot configurations 301 and 302 in which the hook assembly 304 includes a retaining portion 306 that is positioned on the back side 308 of the frame 310. In order to attach the hook 304 to the frame 310, each slot 301 and 302 is provided with an enlarged opening 301' and 302', respectively, that is larger than the diameter or effective diameter of the retaining portion 306. The retaining portion 306 can then be inserted through the opening 301' or 302' and slid along the slot 301' or 302' as the case may be. Once the retaining portion 306 is moved from the opening 301' or 302', because the slot is more narrow than the retaining portion, the hook assembly 304 is in secure sliding engagement with the slot 301 or 302 and can be adjusted to any position along the slot 301 or 302 for supporting an object. To remove the hook assembly 304, the retaining portion 304 is returned to the opening 301' or 302'. A previously described with reference to other embodiments, the slot 302 would be employed of the slot 302 were horizontally oriented.

Figure 7:
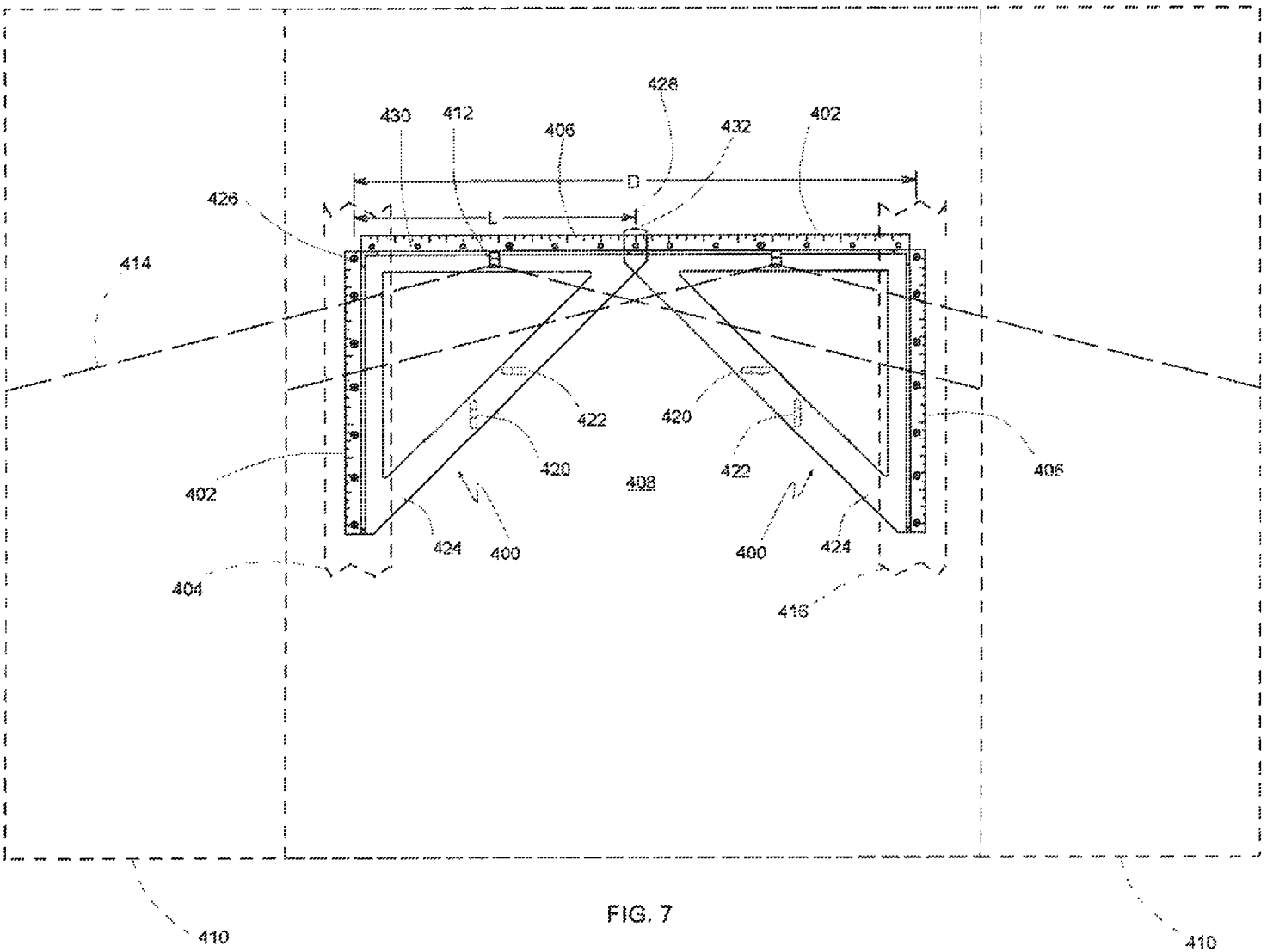
FIG. 7 is a front view of a sixth embodiment of an apparatus for hanging objects from a wall in accordance with the principles of the present invention illustrated in two different positions.

FIG. 7 illustrates an object hanging apparatus, generally indicated at 400, in accordance with the principles of the present invention shown in two different positions. In a first position in which the apparatus 400 is on the left, a first side 402 is attached to a first wall stud 404 with a second side 406 extending horizontally from the first side 402 over the surface 408 of a wall. An object 410 is hung upon a slidable hook 412 as with a generally horizontally extending wire 414 such that the hook 412 is centered with the center of gravity of the object 410. In this case, for a rectangularly shaped object of symmetrical weight distribution, the hook 412 would be centered on the object 410. In this first position of the object 410*l*, the center of the object is nearer the first wall stud 404 resulting in placement and attachment of the apparatus 400 to the stud 404. If however, the center of the object to be hung at a desired wall location is closer to the wall stud 416, the apparatus is rotated 90 degrees into the orientation illustrated where the second side 406 is vertically oriented and the first side 402 is horizontally oriented. Leveling bubbles 420 and 422 may be provided at right angles on the angular cross-member 424 so as to provide a level indicator of horizontal when orienting the first or second side 402 and 406, respectively. The second side 406 is then attached to the wall stud 416 and the hook 412 positioned to be at the center of the object 410 where the object 410 is in the position shown on the right and the wire or cord 414 is placed within the hook 412 in order to hang the object 410. The length L of the apparatus 400 when measured from the center of the attachment holes 426 to the outermost possible position of the hook 412 within the slot 430 is at slightly greater than half the distance D between stud centers. For conventional construction, most studs are spaced 16 inches apart. For such construction, the length L would be greater than 8 inches (e.g., 8½ inches, 9 inches, etc. As such, when hanging an object 410, the user need only determine whether the center of balance of the object 410 is closer to the stud 404 or the stud 416 as the device can accommodate positioning of the hook 412 at any location from the stud to which the apparatus 400 is attached to slightly beyond a center point between studs 404 and 416. Thus, as illustrated, the length L is such that when the apparatus 400 is attached to the stud 404 in a first orientation there is a portion 432 of overlap with the apparatus 400 attached to the stud 416 in a second orientation to ensure that the hook can be positioned at any point along the entire distance D between studs 404 and 416. It is also noted that the apparatus 400 is adapted for use with a larger object 410 of a size that is at least wider and longer than about eight inches to cover the apparatus when the hook is centered along the length L. In order for a symmetrically center balanced object 410 to cover the entire apparatus 400 where the hook 412 can be placed at any location along the slot 430, the object 410 is at least as wide as about twice the length L in order for the object to cover the apparatus for a symmetrically center balanced object, such as a large mirror. For stud spacing of 16 inches, the length L of the apparatus 400 would be approximately at least 8 inches with the object 410 width being approximately at least 16 inches. For stud spacing of 24 inches, the length L of the apparatus 400 would be approximately at least 12 inches and the length L of the apparatus 400 would be approximately at least 24 inches.

For narrower heavy objects to be hung with a hanging device according to the principles of the present invention, the device may be made in smaller sizes than previously discussed if it is not necessary to hang an object a distance from a wall stud that is greater than the distance from the vertical portion of the device to the end of the slot where the hook member can reside. In other words, where the center of an object is to be hung at a closer distance to a wall stud and the width of the object to be hung is that a device of the present invention would otherwise be visible from behind the object, the device may be provided in a smaller size, such that the length L is approximately four or six inches.

FIGS. 8A-8F illustrate yet another embodiment of a hanging device, generally indicated at 440, according to the principles of the present invention. The device 440 may be comprised of a sheet of steel, such as 16 or 18 gage steel, that has been formed and bent into the triangular shape shown as with a stamping method. The device 440 includes three interconnected elongate portions 442, 444 and 446 that define a center opening 448 therein between. The elongate portions 442 and 444 are similarly configured and at a right angle to each other, with each being configured to retain and support the hook member 450 via a respectively slot 452 an 454, respectively, when either the elongate portion 442 or elongate portion 444 is horizontally oriented. The hook member 450 includes a wider, downwardly oriented, U-shaped slide portion 456 that rests over the top edge 458 of the slot 454 and on the back side 459 of the body 462 for sliding engagement therewith. The hook member 450 also includes a more narrow, upwardly oriented, U-shaped portion 460 that is configured to support an object hanging therefrom, as by hanging with a wire or cable attached to the object.

Figure 8A:
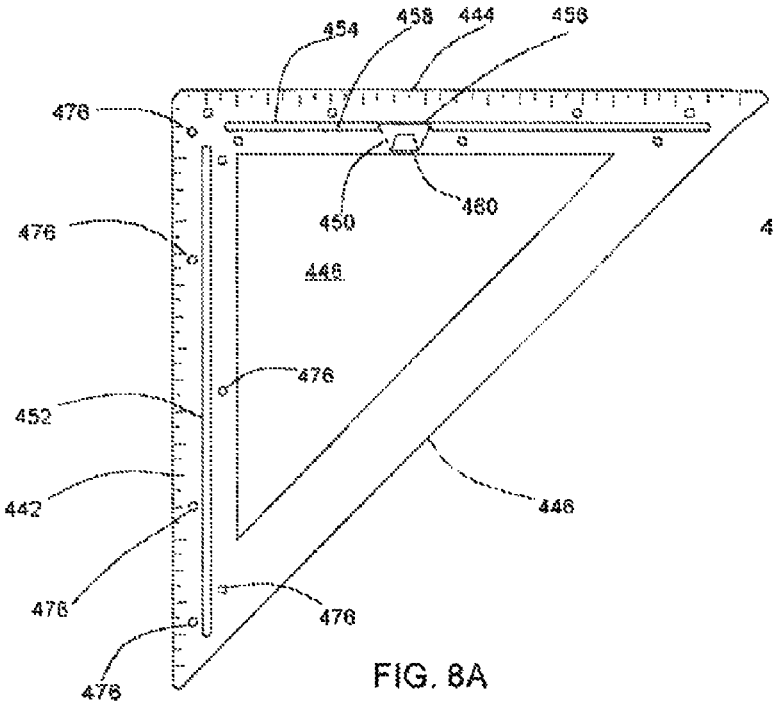
FIGS. 8A-8F are front side, back side right side, left side, top side and bottom side views, respectively, of an apparatus for hanging object from a wall in accordance with the principles of the present invention.
Figure 8C:
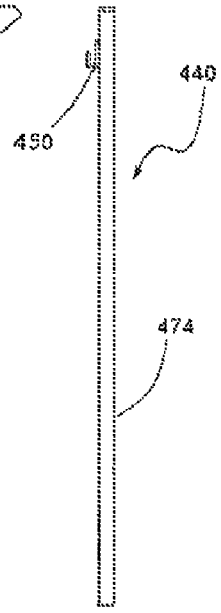
Figure 8B:
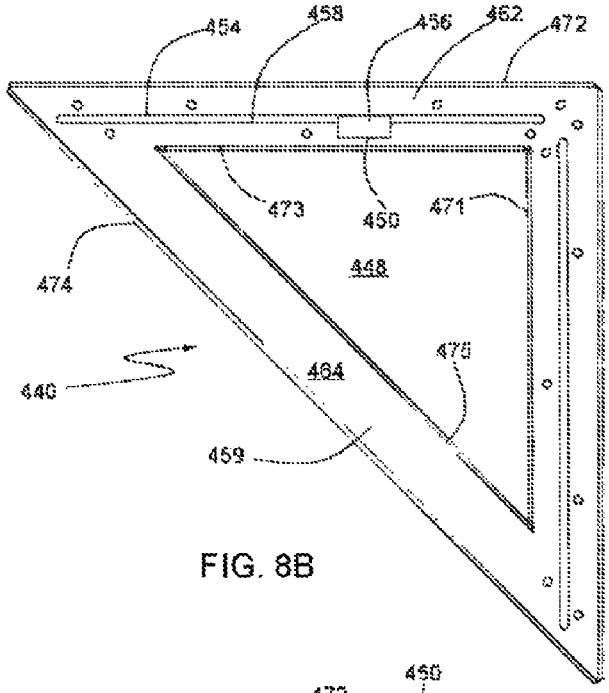
Figure 8D:
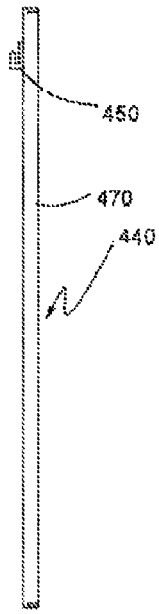
Figure 8E:
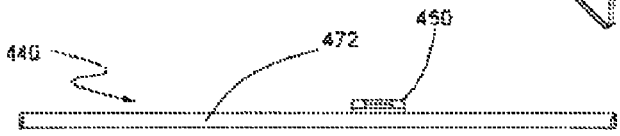
Figure 8F:
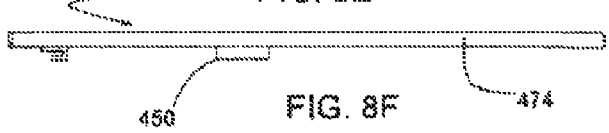

As shown in FIG. 8B, each elongate portion 442, 444 and 446 is bordered by a transversely extending side walls 470, 471, 472, 473, 474 and 475. Each wall 470-475 is integrally formed with its respective elongate portion and may be formed by bending the edges of each elongate portion in a direction toward the back side of the body 462 to approximately 90 degrees from the plane of the body 462. The surface 464 is substantially planar and lies in a first plane. The outwardly extending edges of each wall 470-475 lie in a second plane so that when placed against a surface such as a supporting wall, the edges of the walls 470-475 of the device 440 will lie substantially flat against the surface. The device 440 can be attached to a supporting wall by providing threaded fasteners through the holes 476 into the supporting wall.

It is further contemplated that while the upright member should be attached to a wall stud as with a plurality of screws to adequately hold the device to the wall, it may be possible to use the device in combination with a plurality of sheet rock anchors used to attach the device at multiple locations on both the vertical and horizontal portions in order to support the weight of a heavy object attached thereto.

While there have been described various embodiments of the present invention, those skilled in the art will recognize that other and further changes and modifications may be made thereto without department from the spirit of the invention, and it is intended to claim all such changes and modifications that fall within the true scope of the invention. It is also understood that, as used herein and in the appended claims, the singular forms "a," "an," and "the" include plural reference, unless the context clearly dictates otherwise.

Unless defined otherwise, all technical and scientific terms used herein have the same meanings as commonly understood by one of ordinary skill in the art to which this invention belongs. While various methods of use and structures of the present invention are described herein, any methods or structures similar or equivalent to those described herein may by used in the practice or testing of the present invention. All references cited herein are incorporated by reference in their entirety and for all purposes. In addition, while the foregoing advantages of the present invention are manifested in the illustrated embodiments of the invention, a variety of changes can be made to the configuration, design and construction of the invention to achieve those advantages including combinations of components of the various embodiments. Hence, reference herein to specific details of the structure and function of the present invention is by way of example only and not by way of limitation.

What is claimed is:

1. An apparatus for hanging an object from a wall, comprising:

a generally triangular-shaped frame having a horizontal portion, a vertical portion having a first end depending from a second end of said horizontal portion at a right angle to said horizontal portion, a hypotenuse portion having a first end depending from a first second end of said vertical portion and a second end depending from a first end of said horizontal portion, at least one transversely extending outer wall depending from an edge thereof, and an inner wall transversely depending from an inner edge thereof;

said vertical portion configured for attachment to a wall stud;

a slot formed in said horizontal portion extending a substantial length of said horizontal portion and parallel to a longitudinal axis of said horizontal portion; and a hook member slideably coupled to said slot of said horizontal portion and freely movable along an entire length of said slot, said hook member configured to support a weight of an object suspended therefrom.

2. The apparatus of claim 1, wherein the vertical, horizontal and hypotenuse portions of the frame are integrally formed as a one-piece structure.

3. The apparatus of claim 1, wherein the vertical portion includes a plurality of holes formed therein for receiving fasteners therethrough for attaching the vertical portion to a wall stud.

4. The apparatus of claim 1, wherein the slot is provided with a plurality of evenly spaced protrusions that are wider than a width of the hook member for providing discrete placement positions of the hook member relative to the slot.

5. The apparatus of claim 1, wherein the inner and outer walls and said frame form an I-beam construction.

6. The apparatus of claim 1, further comprising at least one raised portion on said frame, said raised portion laterally extending in a direction opposite of said at least one outer wall.

7. The apparatus of claim 1, wherein each of said frame portions include a transversely extending wall depending from an outer perimeter of said frame and each of said frame portions include an elongate protrusion extending a substantial portion of the respective frame portion and in a lateral direction opposite to the respective transversely extending wall, said wall and said protrusion providing space between said frame and a wall to which the frame is to be attached to allow the hook member to freely slide along said slot and at least partially within said space.

8. The apparatus of claim 1, wherein the vertical portion defines a second slot extending a substantial length of said vertical portion and parallel to a longitudinal axis of said vertical portion and wherein said horizontal portion is configured for attachment to a wall stud and wherein said vertical portion is horizontally oriented, said horizontal portion is vertically oriented and said hook member is coupled to said second slot.

9. The apparatus of claim 1, wherein a length of said horizontal portion is at least approximately 8 inches.

10. The apparatus of claim 9, wherein a length of said vertical portion is at least approximately 8 inches.

11. The apparatus of claim 1, wherein said hook member comprises a one-piece, S-shaped member having a first portion for being inserted through said slot and resting on said horizontal portion adjacent said slot and a second portion for hanging an object therefrom.

12. An apparatus for hanging an object from a support, comprising:

a frame having a first elongate member and a second elongate member having a proximal end depending from a proximal end of said first elongate member at a right angle thereto;

said first elongate member includes at least one first elongate side wall extending a substantial length thereof and includes a first elongate slot formed in a surface thereof and extending a substantial length thereof;

said second elongate member includes at least one second elongate side wall extending a substantial length thereof and includes a second elongate slot formed in a surface thereof and extending a substantial length thereof; and a hook assembly configured for being slideably coupled to said first slot when said first slot is horizontally oriented and to said second slot when said second slot is horizontally oriented, said hook assembly configured to support a weight of an object suspended therefrom.

13. The apparatus of claim 12, further comprising a cross-member attached to and extending between said first and second elongate members and wherein said first and second elongate members and said cross member are integrally formed as a one-piece structure.

14. The apparatus of claim 12, wherein said first and second members are provided with distance markings proximate to said first and second slots, respectively.

15. The apparatus of claim 12, wherein a length of said first and second members is at least approximately 8 inches.

16. The apparatus of claim 12, wherein said hook assembly comprises a one-piece, substantially S-shaped member having a first portion for being inserted through said first or second slot and resting on a corresponding edge of the first or second slot and a second portion for hanging an object therefrom.

* * * * *